US009242774B2

(12) United States Patent
Petrovicova et al.

(10) Patent No.: US 9,242,774 B2
(45) Date of Patent: Jan. 26, 2016

(54) DETERGENT POUCH WITH IMPROVED PROPERTIES

(75) Inventors: Elena Petrovicova, Princeton, NJ (US); Steven Bolkan, Hopewell, NJ (US); Laura Brandt, Flemington, NJ (US); Louis Mazzola, Mahwah, NJ (US); Lucia V. Salas, Princeton, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 0 days.

(21) Appl. No.: 13/816,445

(22) PCT Filed: Aug. 12, 2011

(86) PCT No.: PCT/US2011/047502

§ 371 (c)(1), (2), (4) Date: Apr. 15, 2013

(87) PCT Pub. No.: WO2012/021761

PCT Pub. Date: Feb. 16, 2012

(65) Prior Publication Data

US 2013/0256182 A1 Oct. 3, 2013

Related U.S. Application Data

(60) Provisional application No. 61/373,118, filed on Aug. 12, 2010.

(51) Int. Cl.

| | |
|---|---|
| ***C11D 17/04*** | (2006.01) |
| ***C11D 11/00*** | (2006.01) |
| ***B65D 65/46*** | (2006.01) |

(52) U.S. Cl.

CPC ..... *B65D 65/46* (2013.01); *C11D 17/044* (2013.01)

(58) Field of Classification Search

CPC ..... C11D 17/044; C11D 17/00; B65D 65/46
USPC ..... 510/296, 439
See application file for complete search history.

(56) References Cited

U.S. PATENT DOCUMENTS

| | | | | |
|---|---|---|---|---|
| 3,186,869 | A * | 6/1965 | Friedman | 428/335 |
| 3,374,195 | A * | 3/1968 | Bianco et al. | 524/376 |
| 4,119,604 | A * | 10/1978 | Wysong | 524/377 |
| 4,657,693 | A | 4/1987 | Wise et al. | |
| 4,765,916 | A | 8/1988 | Ogar, Jr. et al. | |
| 4,849,256 | A | 7/1989 | Newman et al. | |
| 4,925,589 | A * | 5/1990 | Lorenz | 252/299.01 |
| 5,234,615 | A * | 8/1993 | Gladfelter et al. | 510/439 |
| 6,767,882 | B1 * | 7/2004 | Jagannath et al. | 510/441 |
| 6,831,051 | B2 | 12/2004 | Sommerville-Roberts | |
| 7,022,656 | B2 | 4/2006 | Verrall et al. | |
| 7,259,134 | B2 | 8/2007 | Beckholt et al. | |
| 7,329,441 | B2 | 2/2008 | Catlin et al. | |
| 7,517,847 | B2 | 4/2009 | Catalfamo | |
| 7,527,880 | B2 | 5/2009 | Catalfamo | |
| 7,563,757 | B2 | 7/2009 | Kouvroukoglou et al. | |
| 7,648,951 | B2 | 1/2010 | Sharma et al. | |
| 2002/0137652 | A1 * | 9/2002 | Gressel et al. | 510/297 |
| 2003/0017955 | A1 | 1/2003 | Forth | |
| 2003/0027739 | A1 * | 2/2003 | Dale et al. | 510/446 |
| 2005/0065051 | A1 | 3/2005 | Catlin | |
| 2006/0128592 | A1 * | 6/2006 | Ross et al. | 510/439 |
| 2006/0165625 | A1 | 7/2006 | Verrall | |
| 2008/0008872 | A1 | 1/2008 | Catalfamo | |
| 2008/0008889 | A1 | 1/2008 | Catalfamo | |
| 2008/0009584 | A1 | 1/2008 | Catalfamo | |
| 2008/0020220 | A1 | 1/2008 | Maurer et al. | |
| 2008/0108748 | A1 | 5/2008 | Buckley et al. | |
| 2008/0161218 | A1 | 7/2008 | Fregonese | |
| 2008/0312123 | A1 | 12/2008 | Weber et al. | |
| 2009/0217462 | A1 | 9/2009 | Holzhauer et al. | |
| 2009/0312220 | A1 | 12/2009 | Boutoille et al. | |
| 2010/0093595 | A1 | 4/2010 | Holzhauer et al. | |

* cited by examiner

*Primary Examiner* — Lorna M Douyon
(74) *Attorney, Agent, or Firm* — Fishman & Associates, LLC

(57) ABSTRACT

An improved detergent pouch that is prepared from at least two water-soluble polymeric films, which are sealed together to contain a detergent composition therein, wherein at least one flexibility-imparting agent is mixed with the detergent composition, or coated onto the pouch to prevent leakage and cracking under stress or unfavorable environmental conditions.

15 Claims, No Drawings

DETERGENT POUCH WITH IMPROVED PROPERTIES

CROSS-REFERENCE TO RELATED APPLICATION

This application is related to U.S. Provisional Patent Application Ser. No. 61/373,118 filed Aug. 12, 2010 and takes priority therefrom.

FIELD OF THE INVENTION

The present invention is directed toward a detergent pouch with improved properties. In particular, at least two water-soluble films are sealed together to prepare the detergent pouch, which further contains a detergent composition. At least one flexibility-imparting agent is mixed within the detergent composition, or coated onto the detergent pouch. The flexibility-imparting agent provides the pouch with a flexibility that surprisingly minimizes leakage and cracking of the pouch under stress or unfavorable environmental conditions.

BACKGROUND OF THE INVENTION

Pouch compositions are known in the art. These compositions have an advantage in that they are easy to dose, handle, transport and store. Recently, water-soluble pouches that contain cleaning or fabric care compositions have become popular.

Typically, the film material that is used to prepare water-soluble pouches is relatively fragile, thin, and must have a high water-reactivity, so that the pouches can release the contained product quickly and completely without leaving residue. However, when the pouches are under stresses from production, packing, transportation, or have been exposed to a moist environment, the thin film material often leads to a premature release of the contained product. Furthermore, when the film material is exposed to low temperature conditions, the pouches may become susceptible to cold shock cracking and failure. Pouched commercial products currently on the market often encounter the above-mentioned difficulties.

Meanwhile, the packaging of additives and the dispensing of compositions into the pouches can also be problematic. For example, additives such as auxiliary agents are typically incorporated within pouched cleaning products as moisture sinkers, but they are often contained separately from the detergent in the same unit dose (i.e. pouch), so that each component can retain its stability prior to consumer usage. Furthermore, it is important to have the detergent in a free-flow, solid particulate form prior to its dispensing into a unit dose, so that a filling machine that packages the pouch can meter and dispense a precise amount of the detergent. Precision in metering and packaging is critical to ensure safety for consumer handling, to reduce the environmental impact caused by excessive cleaning products, and to reduce material cost. Currently, industry practices known in the art have not optimized the packaging of additives with detergent in the same unit dose, so that that the pouch is made to minimize cracks and leakage, and that the detergent composition remains free flowing to be packaged.

Various methods and compositions are known in the prior art, to treat water-soluble films or to reduce moisture within water-soluble pouches. One example is U.S. Pat. No. 7,259,134 to Beckholt et al., which discloses a multi-compartmented pouch that contains one compartment that has a liquid composition. The liquid composition comprises a moisture regulator system made from a mixture of $C_2$-$C_6$ monoalkylene polyol and $C_2$-$C_3$ monoalkylene polyol. While another compartment has a hygroscopic powder to absorb the moisture.

Another example is U.S. Patent Application Number 2008/0020220 to Maurer et al., which discloses a PVOH film that has been pretreated exteriorly with a salt solution, to provide resistance to an accidental exposure to water.

Another example is U.S. Pat. No. 7,648,951 to Sharma et al, which discloses a multi-compartment pouch that contains a moisture-sensitive detergent active, and a humectant in a separate compartment to act as a moisture sink for the detergent.

Another example is U.S. Patent Application Number 2004/0182049 to Duffield, which discloses a PVOH film that has been pre-treated on both sides with a mixture of water, salt, and a water-soluble polymer prior to heat sealing. The film treatment increases the dissolution rate of the sealed area.

Another example is U.S. Pat. No. 7,201,819 to Wiedemann et al., which discloses the incorporation of a detergent in liquid, gel or paste form in a sealed package made of a film, wherein the film was pre-treated with glycerol and heat to avoid crumbling and wrinkle formation.

Finally, U.S. Patent Application 2009/0312220 to Boutoille et al. discloses the formation of a multi-compartmented PVA pouch, which contains a powder detergent therein. The PVA film has been pretreated with a wetting agent such as a plasticizer, to increase its malleability prior to pouching.

However, the above-mentioned references neither mention or address the technical problems that are related to pouch-handling under stress conditions, such as cold shock and cracking, or the difficulties of simultaneously flexing the pouch and maintaining the free-flow characteristic of the solid particulate detergent composition.

Thus, an objective of the present invention is to provide a flexible detergent pouch that contains a detergent composition therein. Another objective is to incorporate at least one flexibility-imparting agent within the detergent composition, so that the pouch subsequently becomes flexible and that the detergent composition remains free flowing. A further objective is to provide a detergent pouch whose flexibility does not decrease considerably with time.

SUMMARY OF THE INVENTION

A detergent pouch is prepared by sealing at least two water-soluble polymeric films together, and further contains a detergent composition. The pouch has at least one flexibility-imparting agent that is coated onto the pouch. In another embodiment, if the detergent composition is a powder, the flexibility-imparting agent is mixed with the detergent composition. The flexibility-imparting agent makes the pouch surprisingly flexible to minimize leakage or cracks under stress or unfavorable environmental conditions.

DETAILED DESCRIPTION OF THE INVENTION

The present invention is directed toward an improved detergent pouch, which is produced by sealing a water-soluble top film and a water-soluble bottom film together with powder, liquid, gel or slurry-like detergent composition contained therein. The pouch is further modified with at least one flexibility-imparting agent to prevent leakage and cracks. The modification is achieved by 1) a chemical treatment of a powdered detergent composition prior to pouch formation, with at least one flexibility-imparting agent that is selected from ionic halide salts, ethylene glycol, propylene glycol, polyol, and derivatives or mixtures thereof, such that the treated detergent composition remains dry and free flowing; and/or 2) a topical treatment of the pouch after the pouch is sealed, with at least one flexibility-imparting agent that is selected from the ionic halide salts, ethylene glycol, propylene glycol, polyol, and derivatives or mixtures thereof.

Water-Soluble Films

Preferred water-soluble films are made from polymers that are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferably, the polymer is selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, polyvinyl alcohols, polyvinyl alcohol copolymers and hydroxypropyl methyl cellulose (HPMC), and mixtures thereof. The most preferred polymers are polyvinyl alcohols. The polymer in the film material comprises at least 60% by weight of the film.

Mixtures of polymers can also be used. This may, in particular, be beneficial to control the mechanical and/or dissolution properties of the compartment or pouch, depending on the application thereof and the required needs. For example, it may be preferred that a mixture of polymers is present in the material of the compartment, whereby one polymer material has a higher water-solubility than another polymer material, and/or one polymer material has a higher mechanical strength than another polymer material. It may be preferred that the mixtures of polymers have different weight average molecular weights. For example, a mixture of PVA or a copolymer thereof of a weight average molecular weight of 10,000-40,000, preferably around 20,000, and of PVA or copolymer thereof, with a weight average molecular weight of about 100,000 to 300,000, preferably around 150,000.

Furthermore, other polymer blend compositions are also useful. A desirable polymer blend is hydrolytically degradable and water-soluble. This blend can be a blend of polylactide and polyvinyl alcohol ("PVA"). The blend is achieved by the mixing of polylactide and polyvinyl alcohol, typically comprising 1-35% by weight polylactide and approximately from 65% to 99% by weight PVA, if the material is to be water-dispersible, or water-soluble. It may be preferred that the PVA present in the film is from 60-98% hydrolysed, preferably 80% to 90%, to improve the dissolution of the material.

Most preferred are water-soluble and stretchable films, as described above. Highly preferred water-soluble films are films which comprise PVA polymers and those have similar properties to the film known under the trade reference M8630®, as sold by Monosol of Gary, Ind., US. Other films suitable for use herein include films that are known under the trade reference PT film, or the K-series of films such as PT-75, as sold by Aicello of Japan, or VF-HP film that is supplied by Kuraray.

The preferred films are formed by extrusion, blow-extrusion, blow-molding, extrusion casting or solution casting into a thin film. These films have a thickness of about 10 to about 200 microns, more preferably of about 40 to about 100 microns, and most preferably of about 60 to about 75 microns.

Detergent Composition

The pouches of the present invention include any type of detergent composition that is selected from laundry, fabric care or dishwashing compositions, pre-treatment, soaking and booster compositions and/or other rinse additive compositions.

In the compositions herein, it may include at least one surfactant and/or builder. The surfactant is selected from anionic, amphoteric, zwitterionic, nonionic (including semi-polar nonionic surfactants), cationic surfactants and mixtures thereof. The builder is a phosphate builder or a fatty acid builder. The builder is preferably water-soluble.

Anionic surfactants are not desirable to be incorporated into the detergent composition, as they may cause tackiness and thereby influence the flowing property of the solid particulate detergent composition. Nonetheless, if an anionic surfactant is added, it is selected from salts (including, for example, sodium, potassium, ammonium, and substituted ammonium salts such as mono-, di- and triethanolamine salts) of the anionic sulfate, sulfonate, carboxylate and sarcosinate surfactants. Most preferred anionic surfactant is Calsoft® F-90.

Preferred nonionic surfactants include alkoxylated alkyl phenols, amides, amines, ethoxylated or propoxylated higher aliphatic alcohols, alkyl polyglucosides, alkyl polysaccharides and sulfonamides. These well known surfactants also include sorbitan esters of $C_{10}$ to $C_{22}$ fatty acids, polyoxyethylene sorbitan esters of $C_{10}$ to $C_{22}$ fatty acids, polyoxyethylene sorbitol esters of $C_{10}$ to $C_{22}$ fatty acids, polyoxyethylene derivatives of $C_6$ to $C_{20}$ fatty phenols, and polyoxyethylene condensates of $C_{10}$ to $C_{22}$ fatty acids or fatty alcohols. Polyoxyethylene and polyoxypropylene analogs of the above surfactants also can be used in the present invention.

Commercially available nonionic surfactants are also suitable for use in this invention. These nonionic surfactants can be Shell Neodol™ 91-6 or Shell Neodol™ 91-2.5 surfactants. Neodol™ 91-6 surfactant is a polyethylene glycol ether of a mixture of synthetic $C_{9-11}$ fatty alcohols with an average of 6 moles of ethylene oxide. Neodol™ 91-2.5 surfactant is an ethoxylated alcohol of a mixture of synthetic $C_{9-11}$ fatty alcohols with an average of 2.5 moles of ethylene oxide. Other useful nonionic surfactants available from Shell are the Neodol 25-7 and Neodol 25-6.5 surfactants. The former is a condensation product of a mixture of higher fatty alcohols averaging about 12 to 15 carbon atoms, with about 7 moles of ethylene oxide and the latter is a corresponding mixture wherein the carbon atom content of the higher fatty alcohol is 12 to 15 and the number of ethylene oxide groups present averages about 6.5. The higher alcohols are primary alkanols.

The detergent composition preferably has a total surfactant level in an amount of about 0.5% to 5% by weight, more preferably of about 1% to 4% by weight, and most preferably of about 2% to 3% by weight of total detergent composition. The surfactant can be incorporated into the detergent composition prior to its pouching, or mixed together with the flexibility-imparting agent to be applied onto the pouch.

Flexibility-Imparting Agents

At least one flexibility-imparting agent is added to modify the detergent pouch, so that the pouch becomes flexible to withstand stress and unfavorable environmental conditions. The flexibility-imparting agent may be sprayed into a powdered detergent composition in the form of a uniform mist. The powdered detergent composition remains free flowing prior to its dispensing into the pouch. The treated detergent composition is then mixed and subsequently pouched ("pre-treatment"). Alternatively, after the enclosure of an untreated detergent composition in any form in the pouch, the flexibility-imparting agent may be sprayed onto the exterior of the pouch in the form of a uniform mist to coat the pouch ("post-treatment"). However, it must be noted that both of the treatments can be applied, that is, the detergent composition is treated with the flexibility-imparting agent, and the pouch that contains the detergent composition is also treated with the flexibility-imparting agent.

The flexibility-imparting agent is selected from a $C_2$-$C_6$ monoalkylene polyol or a mixture thereof, preferably $C_2$-$C_3$ monoalkylene polyol that has a preferred molecular weight of less than about 100. Preferred $C_2$-$C_3$ monoalkylene polyols for use herein include glycerol, ethylene glycol, propylene glycol and mixtures thereof, especially preferred being propylene glycol ("PG").

For the pre-treatment, at least one monoalkylene polyol can be applied in amounts of about 0.5 to about 2 wt. %, and preferably about 1.0 wt. % of the detergent composition. However, an amount greater than 2.5 wt. % is not desirable, as the detergent composition will become tacky, and the metering of a precise amount of this detergent composition for pouching will not be possible.

For post-treatment, at least one monoalkylene polyol is mixed with water (w/w) then sprayed topically onto the water-soluble pouch that contains the untreated detergent composition. About 20% (w/w) to about 40% (w/w) of at least one monoalkylene polyol may be used, and about 25% (w/w) to about 35% (w/w) are also useful. The amount of the aqueous monoalkylene polyol that is applied onto the pouch, is comprised of 0.11 g to about 0.18 g, about 0.141 g to about 0.156 g are also useful. The aqueous monoalkylene polyol is applied onto at least one exterior surface of the pouch in a uniform mist, preferably in a single application.

The flexibility-imparting agents may also be selected from polyalkylene glycols, glycol ethers, glycol esters or a mixture thereof, preferably polyethylene and polypropylene glycols, glycol ethers, glycol esters and mixtures thereof, and most preferred being polyethylene glycol 200 ("PEG 200") and polyethylene glycol 400 ("PEG 400").

For the pre-treatment, at least one polyalkylene polyol can be applied in an amount of about 0.5 to about 2 wt. % of the detergent composition. An amount greater than 2.5 wt. % is not desirable, as the detergent composition will become tacky, and the metering of the precise amount of the detergent composition for pouching will not be possible.

For the post-treatment, at least one polyalkylene glycol may also be mixed with water, and then sprayed topically onto a water-soluble pouch that contains an untreated detergent composition. About 20% (w/w) to about 40% (w/w) of at least one monoalkylene polyol may be used, and about 35% (w/w) is also useful. The aqueous polyalkylene polyol is applied onto at least one exterior surface of the pouch in a uniform mist.

The flexibility-imparting agent can also be selected from ionic halide salts, such as fluoride salts, chloride salts, or bromide salts of an alkali metal or metals. Sodium chloride is especially preferred. These ionic halide salts not only keep the water-soluble detergent pouch flexible under stress, but also absorb moisture within the treated detergent composition, to help it remain free flowing prior to its dispensing into the pouch.

For the post-treatment, the halide salts may be mixed with water then sprayed topically onto a water-soluble pouch that contains an untreated detergent composition. About 0.5% (w/w) to about 15% (w/w) of halide salts may be used, and about 1% (w/w) to about 10% (w/w) is also useful. The aqueous halide salts are applied onto at least one exterior surface of the pouch in a uniform mist.

Builder

The detergent composition of the present invention optionally comprises a builder. Suitable builders include polycarboxylate builders that include cyclic compounds, particularly alicyclic compounds. Other preferred builders include ethylene diamine disuccinic acid and salts thereof (ethylene diamine disuccinates, EDDS), ethylene diamine tetraacetic acid and salts thereof (ethylene diamine tetraacetates, EDTA), diethylene triamine penta acetic acid and salts thereof (diethylene triamine penta acetates, DTPA), aluminosilicates such as zeolite A, B or MAP, $C_{12}$-$C_{18}$ saturated and/or unsaturated fatty acids or salts, preferably sodium salts thereof, and alkali or alkali earth metal carbonates, preferably sodium carbonate.

Detersive Enzymes

Another preferred ingredient useful in the detergent composition is one or more enzyme. Suitable enzymes include enzymes selected from peroxidases, proteases, gluco-amylases, amylases, xylanases, cellulases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, dextranase, transferase, laccase, mannanase, xyloglucanases, or mixtures thereof. The detergent composition generally comprises a cocktail of conventional applicable enzymes such as protease, amylase, cellulase, and lipase.

When enzymes are present, they can be used at very low levels e.g., or from about 0.001 wt. % to about 5% wt. %. In accordance with some customers' preference for "non-biological" detergents, the present invention includes both enzyme-containing and enzyme-free embodiments.

Fabric Care Benefit Agents

The compositions may include a fabric care benefit agent. As used herein, "fabric care benefit agent" refers to any material that can provide fabric care benefits such as fabric softening, color protection, pill/fuzz reduction, anti-abrasion, anti-wrinkle, and the like to garments and fabrics, particularly on cotton and cotton-rich garments and fabrics, when an adequate amount of the material is present on the garment/fabric. Non-limiting examples of fabric care benefit agents include cationic surfactants, clays, silicones, polyolefin waxes, latexes, oily sugar derivatives, cationic polysaccharides, polyurethanes, fatty acids and mixtures thereof. Fabric care benefit agents, when present in the composition, are suitable at levels of up to about 30 wt. %, preferably from about 1 wt. % to about 20 wt. %, and more preferably from about 2 wt. % to about 10 wt. % of the detergent composition.

Solvent System

The solvent system in the present liquid, gel or slurry-like detergent compositions may contain water alone, or a mixture of organic solvents with water. Preferred organic solvents include 1,2-propanediol, ethanol, glycerol, dipropylene glycol, methyl propane diol and mixtures thereof. Other lower alcohols, $C_1$-$C_4$ alkanolamines such as monoethanolamine and triethanolamine, can also be used. Solvent systems can be absent, for example from anhydrous solid embodiments of the invention, but typically are present at levels in the range of from about 0.1 wt. % to about 98 wt. %, preferably at least about 1 wt. % to about 50 wt. %, and more preferably from about 5 wt. % to about 25 wt. %.

Fragrance

The present invention may also include perfumes. The perfumes may be prepared as a premix liquid, encapsulated, or linked with a carrier material, such as cyclodextrin.

Other Adjuncts/Auxiliaries

Examples of other suitable cleaning adjunct materials or auxiliaries include, but are not limited to: metasilicates, alkoxylated benzoic acids or salts thereof such as trimethoxy benzoic acid or a salt thereof (TMBA), enzyme stabilizing systems, scavenging agents including fixing agents for anionic dyes, defoaming agent, complexing agents for anionic surfactants, optical brighteners or fluorescers, soil release polymers, dispersants, suds suppressors, filler, dyes, colorants, biocides, antioxidants, hydrotropes such as toluenesulfonates, cumenesulfonates and naphthalenesulfonates, color speckles, colored beads, spheres or extrudates, clay softening agents and mixtures thereof.

Process for Making the Water-Soluble Pouch

The pouches of the present invention can be prepared by any suitable method. For example, the pouches can be formed from a die having a series of molds, such that a bottom film that has been heat-treated on a roll, then drawn by vacuum into the molds, and a filling machine dispenses the detergent composition onto the film. Thereafter, a top film is heat-treated and moisturized with water, then it is rolled by a machine over the molds that contain the detergent and the bottom film, so that pressure is applied to seal the edges of the top and bottom films together to form a series of pouches, prior to cutting the pouches into unit doses. The pressure applied is preferably about 10 $Nm^{-2}$ to $1.5\times10^{7}$ $Nm^{-2}$, and more preferably about 100 $Nm^{-2}$ to $1\times10^{5}$ $Nm^{2}$. The sealing can be achieved by conventional means such as heat-sealing or solvent welding. The term "solvent-welding" refers to the process of forming at least a partial seal between two or more layers of film material by use of a solvent such as water. The temperature that is applied during this process is preferably about 30° C. to about 250° C., and more preferably from 50° C. to about 200° C.

Method of Treating Detergent Pouches

Example 1

An untreated detergent composition was made by combining the following ingredients:

| Detergent Formulation | |
|---|---|
| Ingredient | Wt. % |
| Malic Acid | 8.0 |
| Metasilicate (green, purple, and blue) | 1.0 |
| Protease (Purafect OX 4000E ™) | 1.5 |
| Amylase (Purastar OXAm 4000E ™) | 0.2 |
| Fragrance | 0.5 |
| Brightener (Tinopal CBS-X) | 0.3 |
| Sodium Percarbonate | 40.0 |
| Polyacrylic acid (Acusol ™ 445 ND) | 0.875 |
| Cellulase (Puradax ® HA 400E) | 0.1 |
| Nonionic surfactant (Neodol ™ 25-7) | 1.0-3.0* |
| Soda Ash (dense) | 44.525 |

*portion added as in Example 2

This detergent composition was used in Example 2, wherein a flexibility-imparting agent chemically treated it. The treated detergent composition was then pouched within PVOH films.

Alternatively, this detergent was incorporated into various PVOH pouches without treatment in Example 3, wherein the PVOH pouches were then modified topically with a flexibility-imparting agent.

Example 2

Different combinations of 0.5, or 1 wt. % of propylene glycol ("PG") with 2 or 2.5 wt. % of a non-ionic surfactant, NEODOL 25-7 ("N*") were mixed with the detergent formulation. Both PG and N* were sprayed onto the detergent powder composition that was prepared in Example 1, so that the treated composition remained free flowing for a filling machine to meter out a precise and consistent amount to be dispensed into the pouch. The treated detergent composition was subsequently pouched. In total, a set of 60 pouches was produced for three different pouch types ("A", "B", and "C").

For the three different sets of pouches, each set had a different thickness and composition from one another. Pouch A was made from MonoSol® M8630 with a top film that had a thickness of 2 mil (60 microns), and a bottom film that had a thickness of 3 mil (75 microns). Pouch B was made from MonoSol® M8630 with a top film that had a thickness of 3 mil and a bottom film that had a thickness of 3 mil. Pouch C was made from MonoSol® M8900 with a top film that had a thickness of 3 mil and a bottom film that had a thickness of 3 mil.

Within each set of 60 pouches, a set of 30 pouches was designated as "TOP" and another set was designated as "BOTTOM". Both sets were stored at 32° F. for 48 hours such that the pouches were acclimated to be "cold shock". Each pouch of the "TOP" set was then removed from the 32° F. environment, and immediately dropped from one foot above the ground at room temperature, such that the top film of the pouch was facing the ground both at the initial dropping and the pouch's landing on the ground. Similarly, each pouch of the "BOTTOM" set was removed from the 32° F. environment and immediately dropped from one foot above ground at room temperature, such that the bottom film of the pouch was facing the ground both at the initial dropping and the pouch's landing on the ground. The number of pouches that broke upon the final impact (landing) on the ground was recorded according to each formulation and pouch type categories:

| | Pouch Types | | | Results | |
|---|---|---|---|---|---|
| Formula/Treatment | Pouch A 2/3 mil | Pouch B 3/3 mil | Pouch C 3/3 mil | # pouch broke upon impact TOP (n = 30) | # pouch broke upon impact BOTTOM (n = 30) |
| 0% PG-control | X | | | 13 | 12 |
| 0% PG-control | | X | | 9 | 12 |
| 0% PG-control | | | X | 23 | 25 |
| 0% PG/2.5% N* | X | | | 26 | 21 |
| 0% PG/2.5% N* | | X | | 16 | 12 |
| 0% PG/2.5% N* | | | X | 26 | 22 |
| 0.5% PG/2.5% N* | X | | | 11 | 6 |
| 0.5% PG/2.5% N* | | X | | 9 | 10 |
| 0.5% PG/2.5% N* | | | X | 23 | 28 |
| 1% PG/2% N* | X | | | 0 | 2 |
| 1% PG/2% N* | | X | | 1 | 2 |
| 1% PG/2% N* | | | X | 9 | 2 |
| 1% PG/2.5% N* | X | | | 1 | 2 |
| 1% PG/2.5% N* | | X | | 5 | 2 |
| 1% PG/2.5% N* | | | X | 15 | 10 |

It can be shown that, a combination of 1 wt. % of propylene glycol ("PG") with 2 or 2.5 wt. % of NEODOL 25-7 within the detergent composition greatly reduced the number of pouches that broke during the drop test under cold shock condition, because only one or two pouches broke for pouch B, as compared to the untreated and surfactant treated (0% PG-control) pouch B that had 9 to 12 pouches broke that during the drop test. Furthermore, the effect could only be the result from the treatment of 1 wt. % of PG, because NEODOL 25-7 alone caused the same, if not worse results (12 to 16 pouches broke for Pouch B).

Example 3

Topical solutions of sodium chloride ("NaCl"), PG, polyethylene glycol 200 ("PEG 200") and polyethylene glycol 400 ("PEG 400") were prepared at various concentrations with water. The solutions were then applied onto the surface of the pouched detergent products. The pouches were made from Pouch A with the same properties as specified in Example 2. The pouches also contained the detergent composition that was made in Example 1. A set of 40 pouches was treated for each topical solution. Within the set of 40, a set of 20 was designated as "TOP" and another set of 20 was designated as "BOTTOM". Both sets were stored at 32° F. for 48 hours, so that the pouches were acclimated to be "cold shock". The "TOP" set was then removed from the 32° F. environment, and immediately dropped from one foot above the ground at 32° F., such that the top film of the pouch was facing the ground both at the initial dropping and the pouch's landing on the ground. Similarly, each pouch of the "BOTTOM" set was removed from the 32° F., environment and immediately dropped one foot above ground at room temperature, such that the bottom film of the pouch was facing the ground at the initial dropping and the pouch's landing on the ground. The number of pouches broke upon the final impact was recorded according to each topical treatment:

| Formula/Treatment Solution (w/water) | Amount applied per side of the pouch (top & bottom) | Type Pouch A 2/3 mil | Results: # Pouch Broke upon impact TOP (n = 20) | Results: # Pouch Broke upon impact BOTTOM (n = 20) |
|---|---|---|---|---|
| 0% PG-control | None | X | 6 | 1 |
| PG 25% | Single Spritz per pouch, 0.141 g | X | 0 | 0 |
| PG 30% | Single Spritz per pouch, 0.148 g | X | 0 | 0 |
| PG 35% | Single Spritz per pouch, 0.156 g | X | 0 | 0 |
| PEG 200 35% | Uniform Mist of all units | X | 0 | 0 |
| PEG 400 35% | Uniform Mist of all units | X | 0 | 0 |
| NaCl 1% | Uniform Mist of all units | X | 0 | 0 |
| NaCl 5% | Uniform Mist of all units | X | 0 | 0 |
| NaCl 10% | Uniform Mist of all units | X | 0 | 0 |

It can be shown from the above drop test, that topical solutions of the above-listed chemicals eliminate the pouch-cracking problem under cold shock condition and stress.

Example 4

A set of pouches made with the specifications from Example 1 and Example 2 was tested for durability and stability under drastic temperatures. The testing groups were as follows: "32° F." (storing at 32° F. for overnight), "122° F." (storing at 122° F. for two weeks), "140° F." (storing at 140° F. for one week), "140° F./RT-7" (storing alternatively between 140° F. and room temperature, for 12 hours at each temperature for 7 times total, so as to simulate product exposure during the transportation to commercial markets in warm climate). Each group comprises a set of 60 of Pouch A containing untreated detergent, and another set of 60 pouches of Pouch B contained detergent treated with 1% PG/2% N*. Each set was then divided into a set of 30 pouches labeled as "TOP", and another set of 30 pouches labeled as "BOTTOM".

Drop tests were conducted for both "TOP" and "BOTTOM" pouches. For "32° F." the drop test parameter was the same as Example 3. For the remaining group, the pouches were equilibrated to 70° F. at 50% humidity for a minimum of 8 hours, then a drop test was conducted on these pouches, by dropping each pouch 6 feet above the ground, wherein the "TOP" pouches were dropped with the top film facing the ground both at initial dropping and their landing on the ground, and the "BOTTOM" pouches were dropped with the bottom film facing the ground both at initial dropping and their landing on the ground. Drop tests were conducted on all pouches except for the noted group (140° F./RT-7 for 0% PG for pouch B) in "*", where only 30 pouches (15 pouches for "TOP" and 15 pouches for "BOTTOM) were tested. Percentages of pouches broke (number of pouches broke over the total number of pouches for the group) were recorded:

| Condition | % Broke: 0% PG-Control in Pouch A (2/3) n = 60 | % Broke: 0% PG-Control in Pouch B (3/3) n = 60 | % Broke: 1% PG + 2.5 *N in Pouch B (3/3) n = 60 |
|---|---|---|---|
| 32° F. | 41% | 35% | 12% |
| 122° F. | 53% | 37% | 20% |
| 140° F. | 73% | 55% | 33% |
| 140° F./RT-7 | 15% | 7%* | 3% |

*n = 30

It can be shown that Pouch B, which contained the chemically treated detergent, had minimal breakage under all temperature conditions after a lengthy storage. Therefore, it is highly desirable to treating the detergent composition with 1% PG/2% N* prior to pouching, so that the pouches can be modified to combat stress, aging, and cracking due to drastic temperature and lengthy storage.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A unit dose water-soluble detergent pouch comprising a detergent composition contained within said pouch, wherein said detergent composition is in particulate form having a coating consisting of propylene glycol and a nonionic surfactant, and said coating minimizes leakage or cracks of said pouch under stressful conditions.

2. The unit dose detergent pouch of claim 1, wherein when said coating resides on said detergent particulate composition, said detergent particulate composition remains free flowing prior to dispensing into said pouch.

3. The unit dose detergent pouch of claim 2, said propylene glycol is present in an amount from about 0.5 to about 2 wt. % of said detergent composition.

4. The unit dose detergent pouch of claim 1, wherein exterior surfaces of said pouch remain substantially intact under stress at 32° F.

5. The unit dose detergent pouch of claim 1, wherein said coating resides on said detergent particulate composition, and on at least one exterior surface of said pouch.

6. The unit dose detergent pouch of claim 1, wherein said pouch is made from at least two water-soluble films.

7. The unit dose detergent pouch of claim 6, wherein said films are polymeric and selected from the group consisting of polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids polycarboxylic acid salts, polyaminoacids, peptides, polyamides, polyacrylamide, copolymers of maleic/acrylic acids, polysaccharides, starch, gelatine, natural gums, polyacrylates, water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, polyvinyl alcohol copolymers, hydroxypropyl methyl cellulose (HPMC), and mixtures thereof.

8. The unit dose detergent pouch of claim 7, wherein said films are made from polyvinyl alcohol.

9. The unit dose detergent pouch of claim 8, wherein said films have a thickness of about 40 to about 100 microns.

10. The unit dose detergent pouch of claim 9, wherein said films have a thickness of 60 to about 75 microns.

11. The unit dose detergent pouch of claim 1, wherein said detergent composition further comprises at least one builder, enzyme, fabric care benefit agent, solvent, or fragrance.

12. A method for preparing a unit dose detergent pouch according to claim 1, comprising:

spraying said propylene glycol and said nonionic surfactant onto said detergent composition to form a treated detergent composition;

enclosing said treated detergent composition with said water-soluble pouch.

13. The method of claim 12, wherein said water soluble pouch is made from at least one polyvinyl alcohol film.

14. The method of claim 13, wherein said film has a wall thickness of about 40 to about 100 microns.

15. The method of claim 12, wherein said propylene glycol is present in an amount from about 0.5 to about 2 wt. % of said treated detergent composition.

* * * * *